United States Patent [19]

Biro

[11] 3,937,257

[45] Feb. 10, 1976

[54] METHOD AND APPARATUS FOR PRESSURIZING RESERVOIRS OF FIRE-FIGHTING EQUIPMENT

[75] Inventor: Guy Dion Biro, Vincennes, France

[73] Assignee: Biro Fils, Paris, France

[22] Filed: Dec. 13, 1974

[21] Appl. No.: 532,483

[52] U.S. Cl. ..... 141/3; 141/4; 141/20

[51] Int. Cl.[2] ..... B65B 1/04; B65B 3/04

[58] Field of Search ..... 141/3, 20, 48, 49, 54, 141/56, 63, 64, 99, 4–7, 1, 2

[56] References Cited

UNITED STATES PATENTS 3,272,238 9/1966 Groppe ..... 141/49

*Primary Examiner*—Houston S. Bell, Jr.

*Attorney, Agent, or Firm*—Haseltine, Lake & Waters

[57] ABSTRACT

Method and apparatus for pressurizing a reservoir comprising directly introducing gas into the reservoir from a first supply source in an amount to instantly pressurize the reservoir and balancing the pressure between a second supply source for service gas and the reservoir via a regulating valve mechanism which controls admission of gas under pressure from the second source into the reservoir when a differential exists between the second pressure source and the pressure prevailing in the reservoir due to its connection with the first pressure source.

4 Claims, 1 Drawing Figure

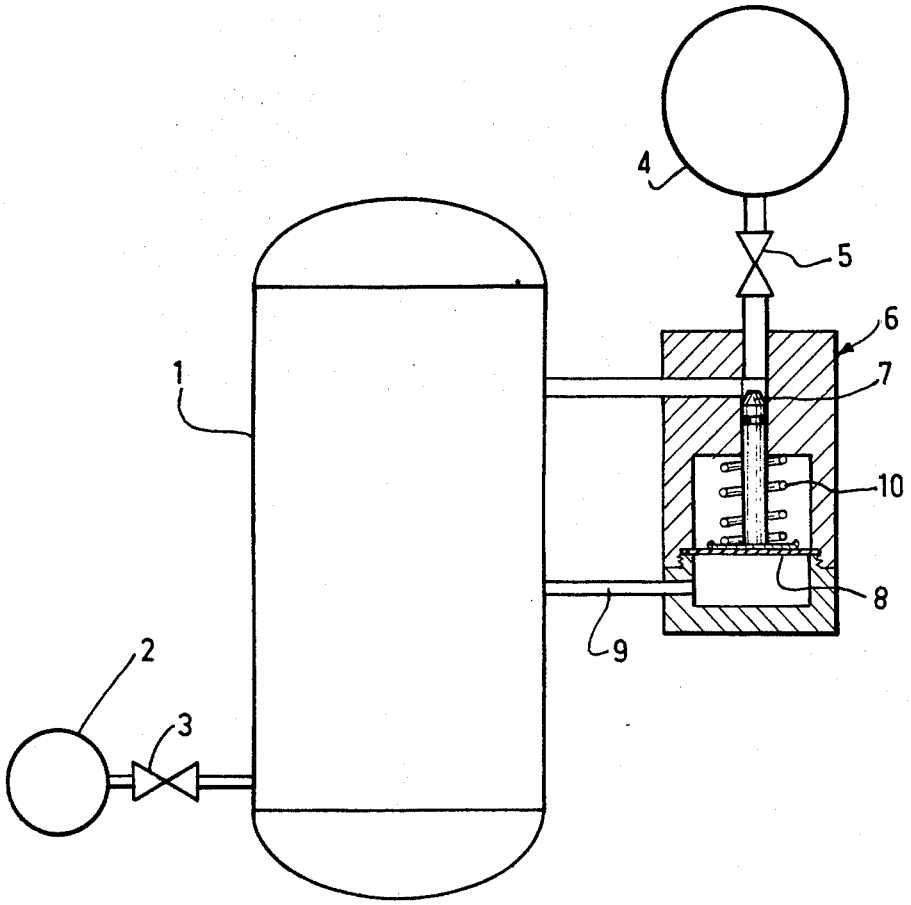
4
5
6
7
1
10
8
9
2
3

METHOD AND APPARATUS FOR PRESSURIZING RESERVOIRS OF FIRE-FIGHTING EQUIPMENT

FIELD OF THE INVENTION

The invention relates to improvements in methods and apparatus for pressurizing reservoirs, notably but not exclusively, powder reservoirs utilized for extinguishing fires.

PRIOR ART

Presently, the feeding of such reservoirs with a pressurized gas generally $CO_2$, is regulated by an expansion system, which causes, by the endothermal effect produced by the passage of the quantity of gas necessary to obtain the service pressure, a frost coating on the expansion system due to the rapid expansion of the gas. As a consequence, the operation of the regulator system is frozen and adversely affected.

This phenomena has the effect of reducing the sensitivity of the regulator system causing substantial delay in the opening and closing thereof and producing an increase in the pressure above the value at which the system has been preadjusted, resulting in a belated feed and a reduction in the pressure in the reservoir below the service pressure.

For example, in the case of fire-fighting equipment, this pressure variation has serious consequences. In fact, the feed quantity varies as a function of the pressure and if the pressure is too low, the feed quantity is insufficient to obtain proper extinction and if the pressure increases, the feed quantity increases causing a recoil of the nozzle.

Furthermore, the need to pass a quantity of gas through the regulation system retards the pressurization of the reservoir.

In conclusion, the system for control of the regulation acts to inhibit the feed and the pressurization which, in the case of fire-fighting equipment, can have catastrophic consequences.

SUMMARY OF THE INVENTION

An object of the invention is to eliminate the above disadvantages by the provision of an improved method for pressurizing reservoirs.

The method of pressurizing reservoirs according to the invention comprises introducing or discharging directly into the reservoir a quantity of gas necessary to pressurize the equipment without passing through the regulation system producing an instantaneous pressure. In addition, the method permits the regulation system to arrive at an equilibrium point and to be ready to assure a perfect control of the service pressure through the regulation system, no gas having yet passed through said system. The gas necessary for the service pressure will be assured by a second gas supply source feeding the regulation system.

This will be immediately regulated because it is regulated from the service pressure and not from atmospheric pressure which will cause an exothermal effect preventing freezing of the regulation system and thereby reducing the variation of pressure to a minimum.

The service pressure will therefore be stable during operation, thereby providing maximum efficiency.

BRIEF DESCRIPTION OF THE DRAWING

The sole FIGURE of the drawing is a diagrammatic illustration of apparatus according to the invention.

DETAILED DESCRIPTION

Referring to the drawing, therein is seen a reservoir 1 which is connected to a supply source 2 containing a quantity of gas under pressure necessary to pressurize reservoir 1. Supply source 2 communicates with reservoir 1 through the intermediary of a valve 3. A second supply source 4 of gas communicates with reservoir 1 through the intermediary of a valve 5 and a discharge regulation means 6 whose outlet opens into reservoir 1. The discharge regulation means 6 is of conventional construction and comprises a slidable valve member 7 controlled by a membrane 8 which is subjected to the pressure in the reservoir 1 through a conduit 9, and to a biassing means constituted by a spring 10.

The operation of the device is as follows:

First the valve 3 is opened to intercommunicate reservoir 1 with supply source 2, allowing the necessary amount of gas to flow into reservoir 1 to pressurize the same. The pressure established in the reservoir 1 acts on the valve member 7 of the regulation means 6 through the intermediary of conduit 9 and the membrane 8. The opening of the valve 5 allows passage of the service gas in the supply 4, this gas being instantaneously regulated since the valve member 7 is already subjected to the pressure prevailing in the reservoir 1. As can be readily understood, in practice, the valves 3 and 5 are opened with a slight delay in time.

The apparatus avoids freezing of the valve member 7, which would otherwise occur if the service gas contained in the supply 4 had to act on the valve member 7 then pass in the reservoir 1 and thereafter apply its pressure on the membrane 8 in order to establish equilibrium if preliminarily only atmospheric pressure acted on membrane 8.

Of course, valve 5 can be omitted when the regulation system is conceived in a manner to allow passage of the service gas from supply 4 when the pressure of the gas in reservoir 1 acts on membrane 8.

In this case, opening of valve 3 causes instantaneous pressurization of reservoir 1 and the passage of the service gas contained in supply 4 without any other intervention.

What is claimed is:

1. A method for pressurizing an operative reservoir with a gas comprising a. opening communication from an auxiliary source containing a determined quantity of gas under pressure and the reservoir to supply said reservoir with the quantity of gas which when expanded pressurizes the reservoir to a predetermined pressure, b. actuating via the pressurizing gas in said reservoir regulation device connecting a main source of service gas under high pressure with said reservoir;

c. opening communication between said main source of gas under high pressure and said regulation device for permitting gas under high pressure to flow into said reservoir and supply the same with expanded gas under the action of said predetermined pressure; and d. automatically balancing the regulation device to effect automatic regulation of the flow of gas under high pressure from said main source to feed said reservoir with expanded gas.

2. Apparatus for pressurizing an operative reservoir comprising: a source of service gas under high pressure for feeding said reservoir; a regulation means having a first input connected to said service gas source, a second input connected to said reservoir for subjecting said regulation means to the pressure in said reservoir and an output connected to said reservoir for feeding the same with expanded gas; an auxiliary source of gas containing a determined quantity of gas under pressure, and a valve member for connecting said auxiliary source to said reservoir; said regulation means including a slidable valve member subjected to the pressure of said reservoir via said second input, and a resilient means acting on said slidable valve member such that the latter assumes a position of balance between the high pressure prevailing at said first input of said regulating means and the pressure in said reservoir at said second input of said regulating means.

3. Apparatus according to claim 2, comprising a second valve member connecting said slidable valve of said regulation means to said service gas source, said second valve member being opened with a slight time delay after opening of said first valve of said auxiliary source of gas.

4. Apparatus according to claim 2, wherein said slide valve of said regulation means is connected directly to said source of service gas and the opening of the input of service gas to said reservoir is effected after operation of said auxiliary source of gas.

* * * * *